US006199569B1

(12) United States Patent
Gibson

(10) Patent No.: US 6,199,569 B1
(45) Date of Patent: Mar. 13, 2001

(54) COMPACT UMBRELLA ANCHOR AND METHOD

(76) Inventor: Bobby L. Gibson, 23130 Grand Rapids La., Spring, TX (US) 77373

( * ) Notice: Subject to any disclaimer, the term of this patent is extended or adjusted under 35 U.S.C. 154(b) by 427 days.

(21) Appl. No.: 08/628,556

(22) Filed: Apr. 10, 1996

(51) Int. Cl.[7] ..... A45B 23/00

(52) U.S. Cl. ..... 135/16; 135/98; 135/99; 52/157

(58) Field of Search ..... 135/16, 98, 99; 248/530, 532, 533, 545; 52/155, 156, 157

(56) References Cited

U.S. PATENT DOCUMENTS

| | | | | |
|---|---|---|---|---|
| 3,318,560 | * | 5/1967 | Garrette et al. | 248/532 X |
| 4,131,122 | | 12/1978 | Brooks . | |
| 4,832,304 | * | 5/1989 | Morgulis | 248/530 X |
| 5,046,699 | * | 9/1991 | Perreault et al. | 135/16 X |
| 5,122,014 | | 6/1992 | Genfan . | |
| 5,152,495 | * | 10/1992 | Jacinto et al. | 135/98 X |
| 5,156,369 | | 10/1992 | Tizzonl . | |
| 5,293,889 | * | 3/1994 | Hall et al. | 248/533 X |
| 5,396,916 | * | 3/1995 | Boissonnault | 135/16 |
| 5,454,435 | | 10/1995 | Reinhart . | |
| 5,457,918 | | 10/1995 | Plourde . | |
| 5,482,246 | | 1/1996 | Derkoski . | |
| 5,535,978 | * | 7/1996 | Rodriguez et al. | 248/530 |

FOREIGN PATENT DOCUMENTS

| | | | | |
|---|---|---|---|---|
| 3309340 | * | 9/1984 | (DE) | 135/16 |
| 0312675 | * | 4/1989 | (EP) | 135/16 |
| 1272460 | * | 10/1970 | (GB) | 135/16 |
| 1278557 | * | 6/1972 | (GB) | 135/16 |
| 2020967 | * | 11/1979 | (GB) | 135/66 |

OTHER PUBLICATIONS

"Better Outdoor Living" Magazine—Advertisement—1–800–926–7000.

* cited by examiner

*Primary Examiner*—Carl D. Friedman
*Assistant Examiner*—Yvonne M. Horton
(74) *Attorney, Agent, or Firm*—Kenneth L. Nash

(57) ABSTRACT

A compact umbrella anchor and method is disclosed that includes a bit with a pin member with an auger blade. The pin member has a small body to support the auger blade without interfering with operation of the larger blade surface. A retractable handle is built onto the tubular body of the umbrella anchor. The handle pivots between an open position and a closed position. Stops on the handle stop rotation at the open position so that the hand grips are directed radially outwardly. The handle has slots that are slightly undersized with respect to the tubular body or in other words the cross-section is slightly greater than a semi-circle, so as to cause the grips to snap gently into the closed position. An umbrella pole can be telescopically interconnected with the tubular body of the umbrella anchor.

20 Claims, 3 Drawing Sheets

COMPACT UMBRELLA ANCHOR AND METHOD

BACKGROUND OF THE INVENTION

1. Field of the Invention

The present invention relates generally to a compact anchor assembly for securing an umbrella to a surface area and, more particularly, to novel apparatus and methods having compact handle means and digging means conveniently built into an umbrella shaft.

2. Description of the Background

One significant problem encountered in water sport activities and other sun-related activities is the problem of providing a place where participants may have temporary respite from the sun. For health and comfort reasons, it is often desirable to provide a shady retreat from the sun, wind screening, and the like, especially for all day activities that may be recreational or otherwise.

Installing a temporary sun screen, such as an umbrella, requires a support for the umbrella pole other shading device. Many people have discovered that the ground is seldom suitable to easily drive an umbrella pole into it to the depth required for supporting the umbrella during even light breezes. The difficulties encountered in supporting umbrella poles are quite significant as attested to by the fact that many patents are directed to solving this problem. In fact, persons who have gone to the beach, pool, or park with an umbrella are typically well aware of the problems involved in securely mounting an umbrella. Firmly affixing the umbrella pole in the ground, within a reasonable time, typically requires equipment designed for this purpose. Ground conditions may include dried dirt, grassy areas, sand, clay, gravel, moisture, and many other variations.

Therefore, various corkscrew devices, heavy metallic poles, hammers, and the like have been used to anchor the umbrella. Such devices, while for the most part effective, have significant drawbacks. For instance, carrying to the beach a twenty-pound metallic pole to make a hole in the sand is undesirable, especially since this will typically be carried along with many other items such as chairs, coolers, and the like. Hammers may be used to drive in umbrella poles, but eventually ruin the umbrella poles by creating unplanned stresses on components, such as connectors, not designed to be impacted.

Logistical problems arise. Regardless of the device selected, extra planning and care is needed to insure that the device actually reaches the destination where it can be used. If forgotten, of course, such devices are useless. Normally, many other items are also desirably carted to the destination so that logistics works strongly against reliable arrival of special anchors, digging tools and the like. Furthermore, even if one manages to remember to bring the special, and usually costly, device to the desired location, there remains the problem of remembering to take it back. Such devices are especially susceptible to being lost after use by neighbors who inevitably encounter the same problem. As well, due to the need to remove items in the dusk, after the eyes have become accustomed to bright light, the device may be left at the location due to oversight.

Attempts to solve the problems associated with anchoring an umbrella include disclosures in the following issued patents:

U.S. Pat. No. 5,454,435, issued Oct. 3, 1995, to L. Reinhardt, discloses a digging tool in the shape of a helk having a fixed handle thereon. The tool is inserted into the sand, rotated, and then removed to form a hole to support an umbrella pole. Other types of digging devices may also be used to form a hole.

U.S. Pat. No. 5,122,014, issued Jun. 16, 1992, to G. S. Genfan, discloses a beach anchoring tubular pole with having twisted propeller-like blades and a removable handle that inserts through a hole in the pole for rotating the pole. After digging into the ground, the handle is then removed and the beach pole is inserted into the tubular pole.

U.S. Pat. No. 5,482,246, issued Jan. 9, 1996, discloses a shaft with a longitudinal end and being adapted to accommodate a beach umbrella post, a spiral-shaped member extending beyond the longitudinal end, an augur disposed around the shaft at another location, and at least one handle coupled with the first longitudinal end of the shaft.

U.S. Pat. No. 5,156,369, issued Oct. 20, 1992, to S.Tozzoni, discloses a ground anchoring arrangement for attachment to the pole of a beach umbrella. The device consists of a hollow member having a rod rotatably supported therein. A spiral screw is attached to the rod, and the other end of the rod is attached to a handle rotator. The screw is rotated to fix the cylinder in the earth whereupon the handle is removed for insertion of the umbrella pole.

U.S. Pat. No. 4,131,122, issued Dec. 27, 1978, to C. R. Brooks, discloses an umbrella with a handle having a pin therein. The pin has a stake-like point at one end and a threaded shank at the other end, and a cap that can be threadably connected with the shank. In the storage position, the pin is threaded into the umbrella's handle. In the stake position, the pin is exposed, and the cap is inserted in the user's pocket.

Consequently, there remains a need for an anchor assembly that operates to provide a firm anchor in various types of ground, that is lightweight, and that is so compact that it comprises part of the umbrella itself and requires no additional heavy, bulky parts to be carried with or lost at the location of desired use. Those skilled in the art have long sought and will appreciate the present invention that addresses these and other problems.

SUMMARY OF THE INVENTION

The present invention provides an improved support structure and method for anchoring a covering member such as an umbrella or the like. The invention comprises an elongate anchor pole having a first end and a second end. A securing means at the second end of the anchor pole secures the covering member to the anchor pole. A bit is fastened to the first end of the elongate first pole and has at least one curved thread for digging in response to rotation of the elongate anchor pole. A pivot member is mounted to the elongate anchor pole to pivotally connect at least one handle to the elongate anchor pole. The at least one handle is pivotally movable between an open position and a closed position. In the open position, the handle is radially outwardly extended for rotating the elongate anchor pole. In the closed position, the handle radially inwardly positioned along a surface of said anchor pole.

An elongate spike member at the distal end of the bit extends distally further than the at least one curved thread for pivotally centering the first pole prior to the digging in response to rotation of the elongate anchor pole. A bit sheath is preferably used for covering the spike during the transporting of the elongate anchor pole. The bit has at least one blade helically disposed thereabout. The spike has a diameter smaller than the elongate anchor pole.

The handle further comprises a tubular member having an inner diameter sized to fit snugly around an outer diameter of the elongate anchor pole and preferably having a circumference large enough to allow snapping into place therearound. For this purpose, a slot is provided that is undersize with respect to the anchor pole. The pivot member is secured to a central portion of the tubular member that forms the handle. The tubular member may have two longitudinal cuts on opposite sides thereof A second pole may be provided on which is mounted the umbrella or other covering. The second pole is preferably telescopically engageable with the anchor pole. A clamp member secures the second pole to the anchor pole.

In operation, the anchor body may be carried to a ground surface where the sun cover is to be anchored. At least one handle is pulled away from the anchor body so that it extends radially outwardly to provide a grip for rotating the anchor body. The ground surface is engaged with a rotary digging bit on the end of the anchor body. The anchor body is rotated with the at least one handle to sink the anchor body into the ground surface. The rotary digging bit is centered by piercing the ground surface with a nail member that restricts radial movement but allows rotational movement of the rotary digging bit. A handle body may simultaneously provide two handles on opposite sides of the anchor body. The at least one handle is closed by pushing it towards the anchor body. The at least one handle is locked into a closed position by providing additional pressure against it in the direction of the anchor body to overcome the spring resistance of the slot edges. The at least one handle is unlocked from the closed position by applying pressure to the at least one handle in a direction away from the anchor body.

It is an object of the present invention to provide an improved umbrella and method.

It is another object of the present invention to provide an anchoring system with all elements therefore built into the shaft of the umbrella that may be formed in two telescoping pieces.

It is yet another object of the present invention to provide a handle assembly that closes to provide a body that is substantially the same outer diameter as the umbrella shaft.

A feature of the present invention is a bit that includes a helical blade for digging and a point member that provides for easily starting and centering of the digging process.

Another feature of the present invention is a tubular handle member that rotates open and closed.

An advantage of the present invention is the elimination of the need to carry additional bulky components for anchoring the umbrella.

Another advantage of the present invention is a convenient compact beach umbrella that includes all anchoring components that may otherwise be easily lost or forgotten when going to the beach, lake, or pool.

These and other objects, features, and advantages of the present invention will become apparent from the drawings, the descriptions given herein, and the appended claims.

While the present invention will be described in connection with presently preferred embodiments, it will be understood that it is not intended to limit the invention to those embodiments. On the contrary, it is intended to cover all alternatives, modifications, and equivalents included within the spirit of the invention and as defined in the appended claims.

DETAILED DESCRIPTION OF THE PREFERRED EMBODIMENTS

Figure 1:
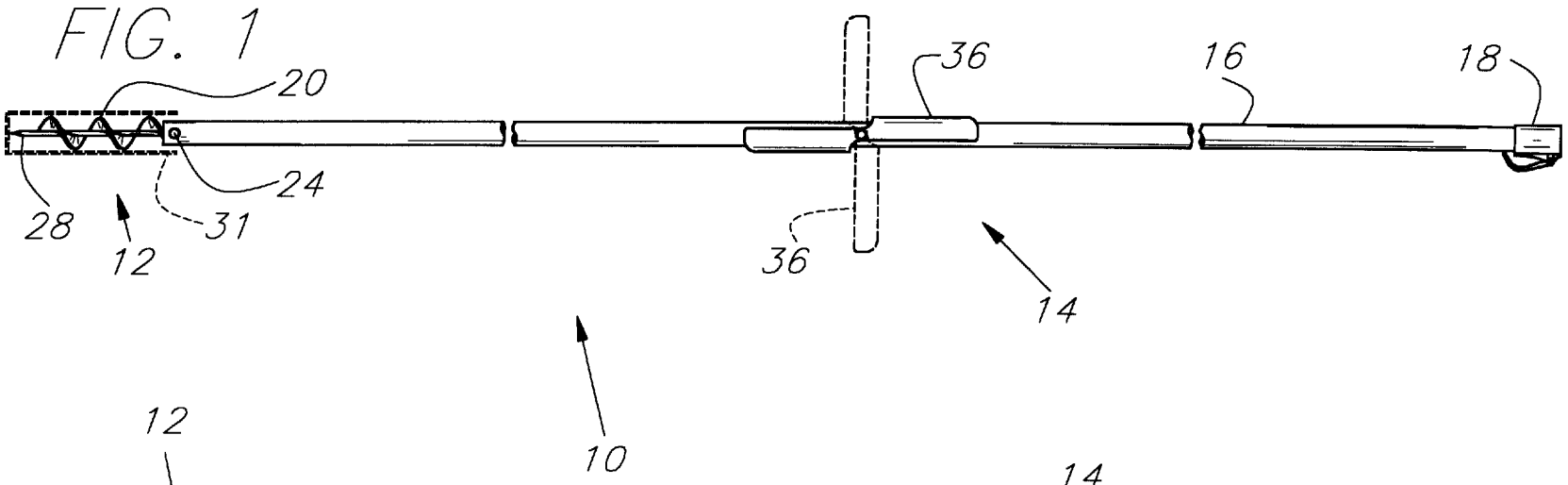
FIG. 1 is an elevational view of a sun cover anchor assembly in accord with the present invention.
Figure 2:
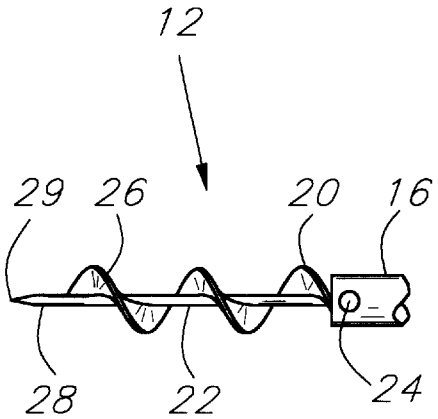
FIG. 2 is an enlarged elevational view of a helical drill portion of the sun cover anchor assembly of FIG. 1.
Figure 3:
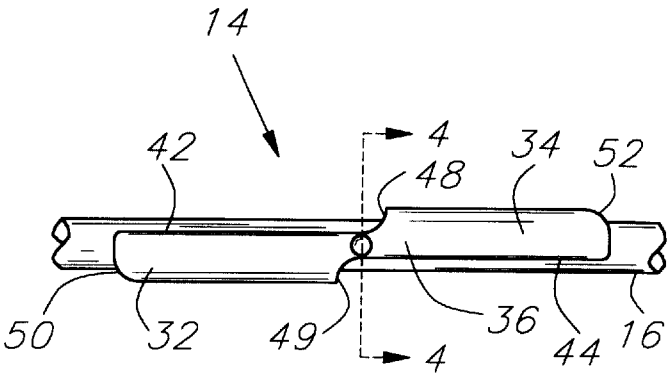
FIG. 3 is an enlarged elevational view of a pivotal handle portion of the sun cover anchor assembly of FIG. 1.
Figure 3A:
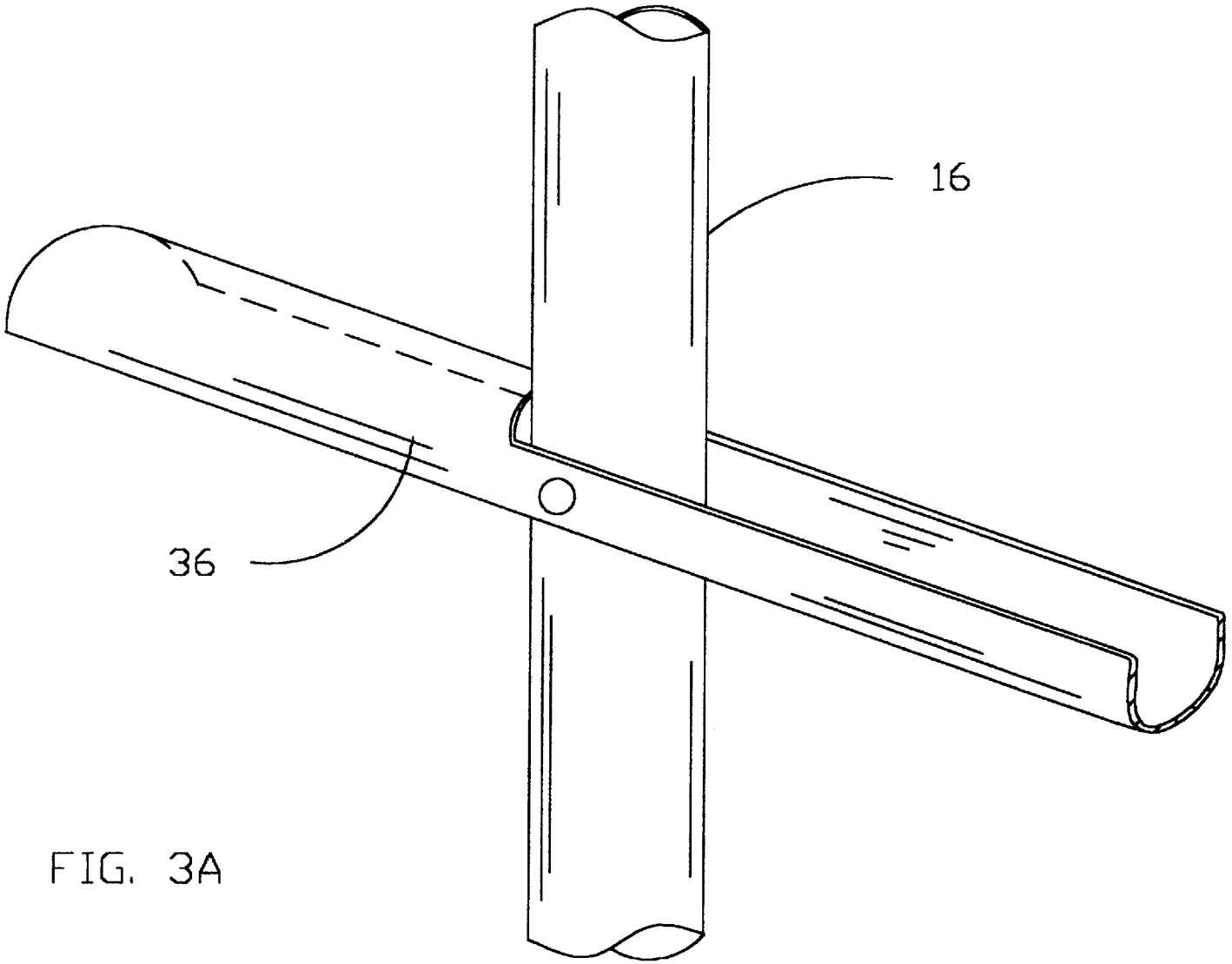
FIG. 3A is a perspective view of the handle of FIG. 3 in the open position.

Referring now to the drawings, and more particularly to FIG. 1, a presently preferred configuration of anchor 10, in accord with the present invention, is illustrated. Anchor 10 may be adapted to securely hold any size umbrella, or the like, that may also be referred to and/or include various sun screens, covers, wind screens, and so forth. Anchor 10 comprises bit 12, that is shown enlarged in FIG. 2, and handle 14, that is shown enlarged in FIG. 3 and FIG. 3A and is also shown in cross-section in FIG. 4.

Figure 5:
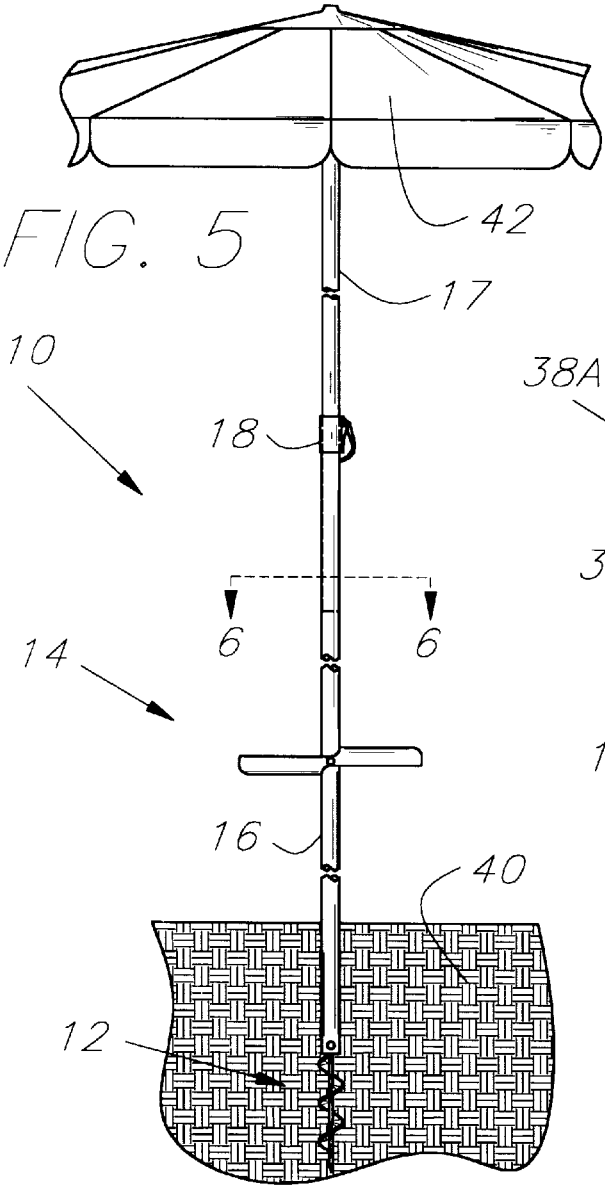
FIG. 5 is an elevational view of a sun cover anchor assembly in position in the ground in accord with the present invention.

Anchor 10 is preferably formed of elongate, cylindrical, tube member 16. Various appropriate materials, known to those skilled in the art, may be used to form tube 16, bit 12, handle 14, and other components of the present invention. Such materials include, but are clearly not limited to, steel, plastic, PVC, polymers, aluminum, metals generally, carbon compounds, combinations of the above, and the like. The invention is not limited to the materials of which it is comprised. In the preferred mode, tube 16 is tubular and preferably telescopically connects to umbrella pole 17 as indicated in FIG. 5. However, anchor 10 could be provided on a single long umbrella pole, a solid umbrella pole, or other type of arrangement as desired. Typically, beach umbrellas are comprised of two sections as shown in FIG. 5 that includes the umbrella with a pole and telescoping extension pole. Anchor 10 may be substituted as the extension pole in older beach umbrellas or conveniently provided as the extension pole in newer beach umbrellas.

A connector 18 is provided to couple anchor 10 to an umbrella pole or other pole member. It will be understood that many other clamps, screws, flanges, and the like could be used for this purpose. Although not a presently preferred embodiment, handle 14, discussed in detail hereinafter, could be modified and repositioned as necessary to provide a wedging action when closed to clamp onto an umbrella pole, if wanted. Thus, many possible arrangements can be provided for connector 18. Many such arrangements are already presently known in the art.

Bit 12 is secured to the bottom end of tube member 16 by pin 24. However, it will be understood that numerous different methods can be used to reliably and sturdily attach or construct bit 12 to be fixably secure with tube member 16. Bit 12 preferably includes auger blade 20 that spirals around a elongate spike body 22. Bit 12 is preferably about three to six inches in length but could be varied in length as may be desired to accommodate special construction materials, costs, ground type, packaging, and the like.

Spike body 22, in this embodiment, has a much smaller diameter than the diameter of tube 16 to allow more surface area for auger blade 20. The more surface area auger blade 20 has, the more force it will typically be able to hold depending on the compactness of the sand. Preferably, auger blade will have an outer diameter slightly greater than tube member 16 to allow tube member 16 to sink more easily into the ground, sand, earth, dirt, or other attachment material. Auger blade 20 is curved, has a circular cross-section, and may have a relatively sharp outer edge 26 for easier digging. Edge 26 is preferably selected so as to have its sharpness balanced for long life-time and ease of digging although excessive sharpness has not been found necessary for excellent operation. Auger blade 20 may include various numbers of turns although about two-four are used in the presently preferred embodiment. Although not required in the presently preferred embodiment, auger blade 20 may also be curved along its radial length so as to be cupped upwardly for increase gripping of the soil, if wanted. To promote ease of rotation, only one auger blade is presently used but another could be provided, if desired. For instance, if auger blade 20 were provided around the tube member 16 or used with a larger diameter spike body, it may be desired to use two or more auger blades.

Nail portion 28 of spike body 22 extends longitudinally away from tube member 16 past auger blade 20 to form the outermost end of anchor 10. Nail portion 28 is small in diameter, much smaller than tube member 16, and therefore is easily driven into ground or sand to its longitudinal length up to the beginning of auger blade 20. Nail portion 28 then centers bit 12 so that bit 12 starts easily to dig straight down without any undesirable radial movement. Thus, nail portion 28 pivotally secures bit 12 to the ground, restricting radial movement of bit 12, while permitting rotation of bit 12 to engage auger blade 20. Due to the small diameter of nail portion 28 and spike body 22, insertion into the ground is eased as compared with devices that have much larger bodies. Furthermore, as discussed above, insertion is aided by leaving most surface area to contact the ground for auger blade 20. Tis arrangement provides a very efficient digging element. Nail portion 28 provides easy starting and stabilization of bit 12 for the drilling without interfering with the operation of the auger blade 20. Also, Spike body 22 efficiently supports the strength of auger blade 20 without interfering in its operation.

Preferably, a cap such as cap 31 indicated in dash, is used to sheath or cover bit 12 during transport and storage so as to prevent any inadvertent damage caused by the point 29 of nail portion 28. Although point 29 is not particularly sharp, it is common sense that it is desirable to keep pointed objects blunted or covered when not in use to prevent damage or injury.

The preferred embodiment of handle 14 provides a readily handy, stream-lined, sturdy, long-lasting, handle to rotate tube 16 for quickly and firmly anchoring the assembly. Hand grips 32 and 34 are preferably formed on a tubular handle member 36. Therefore, they provide smooth, reasonably sized grips, that accept force without injuring the hands. In fact, the force necessary to insert anchor 10, due to reasons discussed hereinbefore, is typically so small that operation is quite light without any undue force necessary. Of course, to drastically increase the torque that can be applied, it is only necessary to make handle 14 longer or to hinge it on one end as discussed subsequently. Although not found necessary, due the stream-lined design, an increase in handle length can easily be made without making the device any more bulky for transport. In the preferred embodiment, each hand grip 32 and 34, respectively, is about five or six inches in length. However, this may be adjusted as desired.

Figure 4:
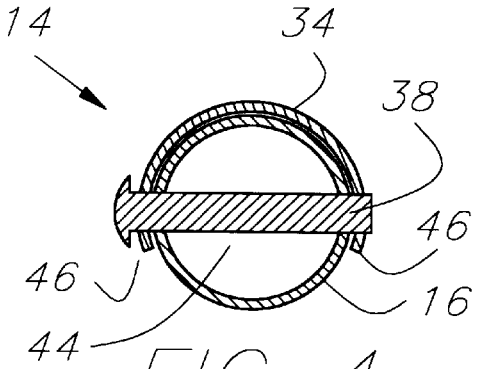
FIG. 4 is a cross-sectional view along line 4—4 of FIG. 3.

Tubular handle member 36 rotates, or pivots, between a closed position as shown in solid lines in FIG. 1 and an open position as shown in dashed lines in FIG. 1. In the open or operating position, hand grips 32 and 34 are directed radially outwardly so as to be transverse or orthogonal with respect to tube 16. In a closed position for normal use and for transport, hand grips 32 and 34 are longitudinally positioned to be substantially parallel with respect to tube 16. Since hand grips 32 and 34 are part of the same tubular handle member 36, they move simultaneously outwardly to the open position or inwardly to the closed position. For this purpose, pin or pivot member 38 rotationally secures tubular handle member about midway thereof with respect to tube 16 as shown in FIG. 4. This construction can be quite sturdy, especially when substantial, ⅛ to ¼ inch thick, metallic tubular components are used as in the presently preferred embodiment. In the presently preferred embodiment, rugged non-corrosive metals are used but, as stated hereinbefore, the invention is not limited to specific materials.

Tubular handle member has two longitudinal slots 42 and 44, respectively, wherein tube 16 is received. In cross-section, as shown in FIG. 4, tubular handle member is approximately semi-circular. Preferably, slots 42 and 44, are cut such that there is some overlap, referred to as ends 46, that extend beyond a semi-circle to close back on tube 16 so as to form a springing lock. Thus, ends 46 must be pushed open by a slight additional force to either place tubular handle member in the closed position or pull it out of the closed position. This forms a simple snap lock for handle 14 in the preferred embodiment of the present invention. The slots could also be cut in tapered fashion or otherwise, if wanted.

It will also be noted that pin 38 could be placed on one end or elsewhere with respect to tubular handle member 36. If placed on one end, then a single handle, with double the available torque for the same length of tubular handle member 36, is formed. However, as stated before, the rotational force required to bury bit 12 to a good depth for solidly securing anchor 10 has been found to be relatively light. Therefore, providing two handles increases the speed of operation. The greater torque option has not been found to be necessary, but remains available. Slots 42 and 44 terminate at stop points 48 and 49, respectively. Stop points 48 and 49 are selected to prevent further rotation of tubular handle member 36 once hand grips 32 and 34 are directed radially outwardly at approximate right angles with respect to tubular body 16. Preferably ends 50 and 52 are rounded to prevent any unnecessary sharp corners.

In operation, anchor 10 is preferably part of a typical beach umbrella kit that has two poles. Many beach umbrellas are sold in this manner, typically with a carrying bag. Thus, anchor 10 may be obtained separately for use with other umbrellas or may be provided as part of the standard umbrella kit. Because anchor 10 takes up no additional room, the same convenient carrying bag can be used except that a built-in anchor kit for the umbrella is provided. Unlike bulky digging devices, if the umbrella is remembered with the present invention, then the umbrella anchor is also remembered.

Figure 6:
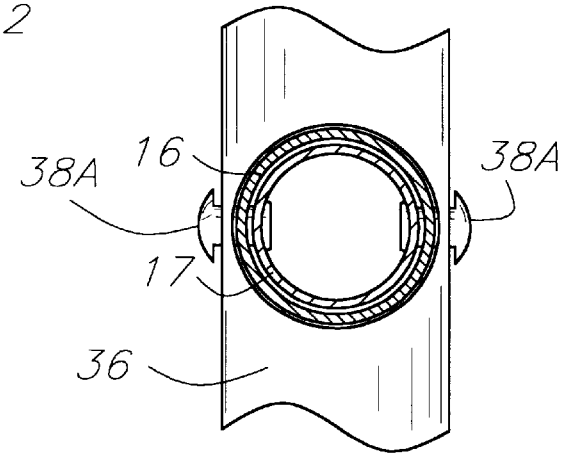
FIG. 6 is a cross-sectional view along line 6—6 of FIG. 5.

Upon reaching the desired destination, indicated in FIG. 5 and FIG. 6 as ground 40, anchor 10 is buried to a desired depth. Ground 40 may comprise many soil types may also include various types of vegetation such as grass. Umbrella 42 is affixed to umbrella pole 17 that, in turn, telescopically connects to anchor 10. Clamp 18 on anchor 10, discussed hereinbefore, may be used to lock umbrella pole 17 to anchor 10 at the desired height. Hand grips 34 and 36 are pulled outwardly away from tube 16 with a radially directed force to cause tubular handle member 36 to rotate. A slight additional pull is required to snap tubular handle member 36 out of the closed position. The pull causes handle member 36 to rotate or pivot until hand grips 32 and 34 are pointed radially outwardly, at which time further rotation of tubular handle member 36 is prevented by stops 48 an 49.

Nail portion 28 is inserted into ground 40. Rotation of hand grips 32 and 34 cause auger blade 20 to dig into ground 40 so that tube 16 of anchor 10 is pulled into ground 40. This action continues until it is determined that anchor 10 is deep enough in ground 40 so as to be suitably secured to ground 40, at which time rotation can stop. Handle member 36 can then be pushed inwardly to a closed position with a radially inwardly directed force to pivot handle member 36 parallel to anchor tube 16. Ends 46 cause handle member to snap into and remain in the closed position.

Umbrella pole 17 may then be telescopically inserted into anchor tube 16. FIG. 6 shows a cross-sectional view of the telescoping bodies. Note that two pins 38A are used in place of pin 38 in this embodiment to allow, if wanted, a space through with a modified pole 17 could be inserted if desired. Pins 38A could be modified as cams or otherwise to rotate and lock into slots that could be formed on umbrella pole 17, if wanted. However, the preferred embodiment for general usage, for the sake of simplicity, presently uses a smooth umbrella pole as described earlier.

The foregoing disclosure and description of the invention is illustrative and explanatory thereof, and it will appreciated by those skilled in the art, that numerous changes, only some of which have been mentioned hereinbefore, in the size, shape and materials as well as in the various details of the illustrated construction or combinations of features of the various anchor elements may be made without departing from the spirit of the invention.

What is claimed is:

1. An improved support structure member, comprising:

an elongate anchor pole having a first end and a second end and having an outer surface;

a bit secured to said first end of said elongate anchor pole, said bit having at least one curved thread for digging in response to rotation of said elongate anchor pole;

a pivot member secured to said elongate anchor pole; and a handle pivotally connected to said elongate anchor pole with said pivot member such that said handle is movable between an open position in which said handle is radially outwardly extended for rotating said elongate anchor pole, and a closed position in which said handle is positioned radially inwardly to be adjacent a surface of said elongate anchor pole, said pivot member and said handle being configured to conform to said outer surface of said elongate pole when said handle is in said closed position.

2. The arrangement as defined in claim 1, further comprising:

an elongate spike member for said bit extending past said at least one curved thread to form a distal end of said bit, said elongate spike member being operable for pivotally centering said first pole prior to said digging in response to rotation of said elongate anchor pole.

3. The arrangement of claim 1, wherein said handle further comprises:

a tubular handle member having an inner diameter sized to fit snugly around an outer diameter of said elongate anchor pole.

4. The arrangement of claim 3, wherein:

said pivot member is secured to a central portion of said tubular handle member.

5. The arrangement of claim 3, wherein:

said tubular handle member is cut longitudinally so as to have a substantially semi-circular cross-section.

6. The arrangement of claim 3, wherein:

said tubular handle member has two longitudinal cuts on opposite sides thereof.

7. The arrangement of claim 1, further comprising:

a second pole being telescopically engageable with said anchor pole; and a clamp member for securing said second pole to said anchor pole.

8. An umbrella support assembly for anchoring an umbrella into a section of ground, comprising:

an anchor section having a first end and a second end, said second end being operable for supporting said umbrella with respect to said ground;

a rotary bit for digging into said ground in response to rotation of said anchor pole;

a handle for rotating said anchor section and being affixed to said anchor section for movement between an open position and a closed position, said handle being affixed to said anchor section for movement to a radially outwardly extended position in said open position, said handle being affixed to said anchor section for movement to a longitudinally directed position with respect to said anchor section in said closed position, said handle engaging said anchor section along the length of said handle portion when said handle is in said closed position.

9. The umbrella support assembly of claim 8, wherein said rotary bit further comprises:

a blade operable for rotatably digging; and a a nail member having a much smaller diameter than said anchor section for insertion into said ground and for centrally securing said anchor section so as to substantially prevent radial movement of said anchor section in response to said rotatably digging of said blade.

10. The umbrella support assembly of claim 8, further comprising:

a pivot member secured to said handle and said anchor section to allow pivotal movement therebetween.

11. The arrangement of claim 10, wherein:

said pivot member is secured to a central portion of said handle.

12. The arrangement of claim 8, wherein the handle further comprises:

a tubular handle member having a cross-section with a slot for receiving said elongate anchor section, said slot being undersize with respect to said anchor section to provide a springing engagement with said elongate anchor section for snapping into and out of said closed position.

13. An improved support member for anchoring a sun cover into a section of ground, comprising:

an elongate anchor pole having a first end and a second end;

a bit secured to said first end of said elongate anchor pole, said bit having an elongate centrally disposed spike and at least one blade helically disposed thereabout, said at least one blade forms from two to four turns around said spike, said spike having a diameter much smaller than said elongate anchor pole along its length;

a handle secured to said elongate anchor pole, said handle being operable for rotating said elongate anchor pole to thereby rotate said bit and a bit cover for covering said spike during said transporting of said elongate anchor pole.

14. The improved support member of claim 13, further comprising:

a pivot member for pivotally securing said handle with respect to said elongate anchor pole, said handle being tubular and being longitudinally cut to fit around said elongate anchor pole, said pivot member engaging said handle on either side of said anchor pole.

15. A method for anchoring a pole, comprising:

carrying an anchor body to a ground surface where said pole is to be anchored;

hingeably pivoting a monolithic handle away from said anchor body so that it extends radially outwardly to provide at least two hand grips on opposite sides of said anchor body for rotating said anchor body;

engaging a rotary digging bit with said ground surface; and rotating said anchor body with said at least one handle to sink said anchor body into said ground surface.

16. The method of claim 13, further comprising:

pushing downwardly on at least one of said two hand grips while turning said anchor body.

17. The method of claim 15, further comprising:

rotating said monolithic handle about its center to provide said at least two hand grips on opposite sides of said anchor body.

18. The method of claim 15, further comprising:

closing said monolithic handle by pushing it towards said anchor body.

19. The method of claim 16, further comprising:

springably locking said monolithic handle into a closed position by providing additional pressure against it in the direction of said anchor body.

20. The method of claim 15, further comprising:

springably unlocking said monolithic handle from a closed position by applying pressure to said monolithic handle in a direction away from said anchor body.

* * * * *